US010497244B2

(12) United States Patent
Bernstein

(10) Patent No.: US 10,497,244 B2
(45) **Date of Patent: *Dec. 3, 2019**

(54) ISSUING ALARM SIGNAL TO OPERATIVES

(71) Applicant: Wearable Technology Limited, Stoney Stanton, Leicestershire (GB)

(72) Inventor: Mark Jonathan Bernstein, Stoney Stanton (GB)

(73) Assignee: Wearable Technology Limited, Stoney Stanton, Leicestershire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/889,251

(22) Filed: Feb. 6, 2018

(65) Prior Publication Data

US 2018/0182220 A1 Jun. 28, 2018

Related U.S. Application Data

(63) Continuation of application No. 14/972,244, filed on Dec. 17, 2015, now Pat. No. 9,922,519.

(51) Int. Cl.

| | |
|---|---|
| ***G08B 21/02*** | (2006.01) |
| ***G08B 5/36*** | (2006.01) |
| ***G08B 21/04*** | (2006.01) |
| ***G08B 21/14*** | (2006.01) |
| ***G08B 25/00*** | (2006.01) |
| ***G08B 25/01*** | (2006.01) |

(52) U.S. Cl.

CPC ..... *G08B 21/02* (2013.01); *G08B 5/36* (2013.01); *G08B 21/0453* (2013.01); *G08B 21/14* (2013.01); *G08B 25/009* (2013.01); *G08B 25/016* (2013.01)

(58) Field of Classification Search

CPC .... G08B 21/02; G08B 21/0453; G08B 21/14; G08B 25/009; G08B 25/016; G08B 5/36

USPC ..... 340/532

See application file for complete search history.

(56) References Cited

U.S. PATENT DOCUMENTS

| | | | | |
|---|---|---|---|---|
| 7,148,797 | B2 * | 12/2006 | Albert | G08B 17/00 340/521 |
| 9,922,519 | B2 * | 3/2018 | Bernstein | G08B 21/02 |
| 2001/0024949 | A1 | 9/2001 | Yanagida | |
| 2005/0001728 | A1 * | 1/2005 | Appelt | G08B 21/02 340/573.1 |
| 2009/0313748 | A1 * | 12/2009 | Guedes Lopes Da Fonseca | G06F 1/163 2/458 |

(Continued)

FOREIGN PATENT DOCUMENTS

| | | | |
|---|---|---|---|
| CN | 102600565 | A | 7/2012 |
| DE | 202005021140 | U1 | 8/2007 |

(Continued)

*Primary Examiner* — Hirdepal Singh

(74) *Attorney, Agent, or Firm* — James Creighton Wray

(57) ABSTRACT

A jacket 101 has a detector, such as a gas detector, for detecting an environmental hazard. The jacket has a first warning device for issuing a first warning in response to detecting the environmental hazard. Furthermore, the jacket is provided with a transmission device for transmitting a warning signal to similar jackets worn by operatives within the environment. Each jacket includes a second warning device for issuing a second warning in response to receiving a warning signal from any other jackets or clothing.

8 Claims, 14 Drawing Sheets

(56) References Cited

U.S. PATENT DOCUMENTS

| | | | | |
|---|---|---|---|---|
| 2010/0315228 | A1* | 12/2010 | Grilliot | G08B 21/04 340/540 |
| 2011/0169652 | A1* | 7/2011 | Novak | G06F 3/014 340/686.6 |
| 2012/0136231 | A1* | 5/2012 | Markel | A61B 5/0015 600/388 |
| 2015/0112159 | A1* | 4/2015 | He | A61B 5/0285 600/301 |
| 2015/0145686 | A1* | 5/2015 | Johnson, Jr. | G06K 7/0095 340/632 |
| 2015/0279187 | A1* | 10/2015 | Kranz | G08B 21/0415 340/539.12 |
| 2016/0324487 | A1 | 11/2016 | Guo | |
| 2018/0075721 | A1* | 3/2018 | Oliver | H04W 4/70 |

FOREIGN PATENT DOCUMENTS

| | | | | |
|---|---|---|---|---|
| EP | 2138965 | A1 | 12/2009 | |
| GB | 2466503 | A | 6/2010 | |
| WO | 2016062423 | A1 | 4/2016 | |
| WO | WO 2016062423 | A1 * | 4/2016 | G06Q 10/10 |

* cited by examiner

| ID REF | ADDRESS | GROUP ID | LEADER | EXTERNAL |
|---|---|---|---|---|
| IDR 1 | A1 | 001 | YES | EX1 |
| IDR 2 | A2 | 002 | NO | — |
| IDR 3 | A3 | 003 | NO | — |
| IDR 4 | A4 | 004 | NO | — |
| IDR 5 | A5 | 005 | NO | EX2 |

801 802 803 804 805

*Fig. 8*

ISSUING ALARM SIGNAL TO OPERATIVES

CROSS REFERENCE TO RELATED APPLICATIONS

This application is a continuation of application Ser. No. 14/972,244 filed Dec. 17, 2015 which claims priority from United Kingdom Patent Application No. 14 22 901.7, filed Dec. 18, 2014, the entire disclosure of which is incorporated herein by reference in its entirety.

TECHNICAL FIELD

The present invention relates to an apparatus for use in a multi-operative activity, during which there is a risk of one or more of said operatives being exposed to an environmental hazard. The present invention also relates to a method of warning operatives when working on a multi-operative activity of the presence of an environmental hazard.

BACKGROUND OF THE INVENTION

It is known to provide garments with various types of detectors. These detectors may identify hazards in the environment, possibly chemical or radioactive for example. It is also known to provide garments with communication equipment such that the user of a particular garment may maintain a communication link with a base station.

BRIEF SUMMARY OF THE INVENTION

According to an aspect of the present invention, there is provided an apparatus for use in a multi-operative activity, during which there is a risk of one or more of said operatives being exposed to an environmental hazard, comprising: a plurality of items of clothing, wherein each said item of clothing is worn by a respective operative and comprises: a detector for detecting an environmental hazard; a first warning device for issuing a first warning in response to detecting said environmental hazard; a transmission device for transmitting a warning signal to others of said items of clothing; and a second warning device for issuing a second warning in response to receiving a warning signal from any other of said items of clothing.

In an embodiment, the first a warning device is a light emitting diode configured to emit light of a first predetermined color. Furthermore, the second warning device may also be a light emitting diode configured to emit light of a second predetermined color different from said first predetermined color.

According to a second aspect of the present invention, there is provided a method of warning operatives when working on a multi-operative activity of the presence of an environmental hazard, comprising the steps of: issuing each operative with an item of clothing having a detector for detecting an environmental hazard, wherein each said item of clothing is configured to: issue a first warning in response to detecting said environmental hazard; transmit a first warning signal; and issue a second warning in response to the direct reception of a warning signal from another of said items of clothing.

In an embodiment, a second warning signal is generated if communication with another item of clothing cannot be established. Heartbeat signals may be transmitted periodically to confirm the possibility of establishing communication.

BRIEF DESCRIPTION OF THE DRAWINGS

FIG. 8 shows an example of an array created by the procedure identified in FIG. 7;

DETAILED DESCRIPTION OF EXAMPLE EMBODIMENTS

FIG. 1

Figure 1:
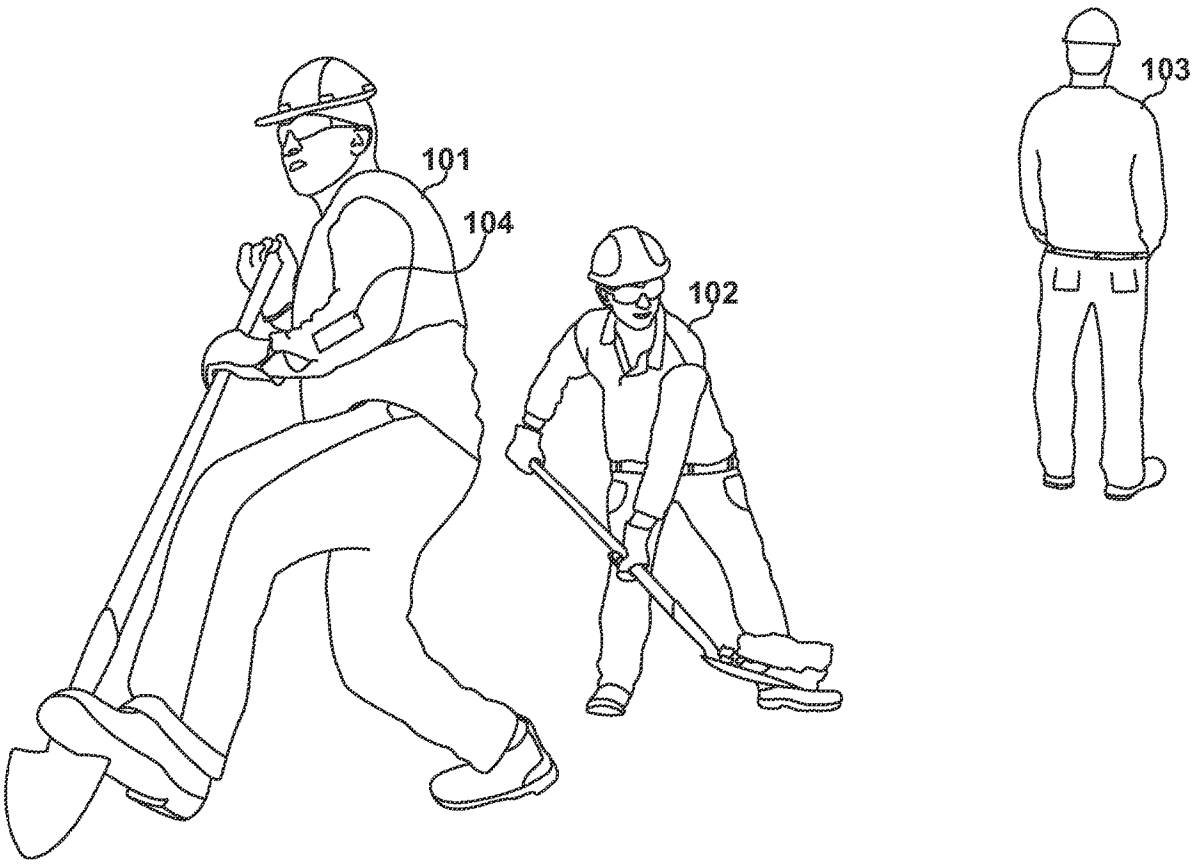
FIG. 1 shows a multi-user activity.

A multiuser activity is illustrated in FIG. 1 in which each user wears an item of clothing 101, 102, 103, possibly in the form of a high visibility jacket.

Each jacket, such as jacket 101, includes a transmission device for transmitting output data. The jacket includes a data generating device configured to produce output data. Furthermore, each jacket also includes a receiving device for receiving transmissions from similar items worn by other participants in the activity. The jacket also includes an interface device 104 for conveying information to a user in response to receiving these transmissions.

Thus, when conducting the activity illustrated in FIG. 1, it is assumed that potential hazards exist. These hazards may exist due to the nature of the work itself, due to the presence of potentially hazardous substances or radiation or due to an external threat. Thus, for example, the multi-user activity could involve the removal of hazardous devices and it is possible that the activity is being conducted in a hostile environment.

FIG. 2

In an embodiment, the clothing item is assembled from material components and a first material component and a second material component may be joined together by stitches, thereby forming a seam. To construct a jacket, many seams of this type are required and several layers of material may be included at the seams, such that the seams represent a relatively strong region of the jacket that is often less susceptible to being strained in response to stresses applied thereto during the use of the jacket while a user is engaged in the activity.

Figure 2:
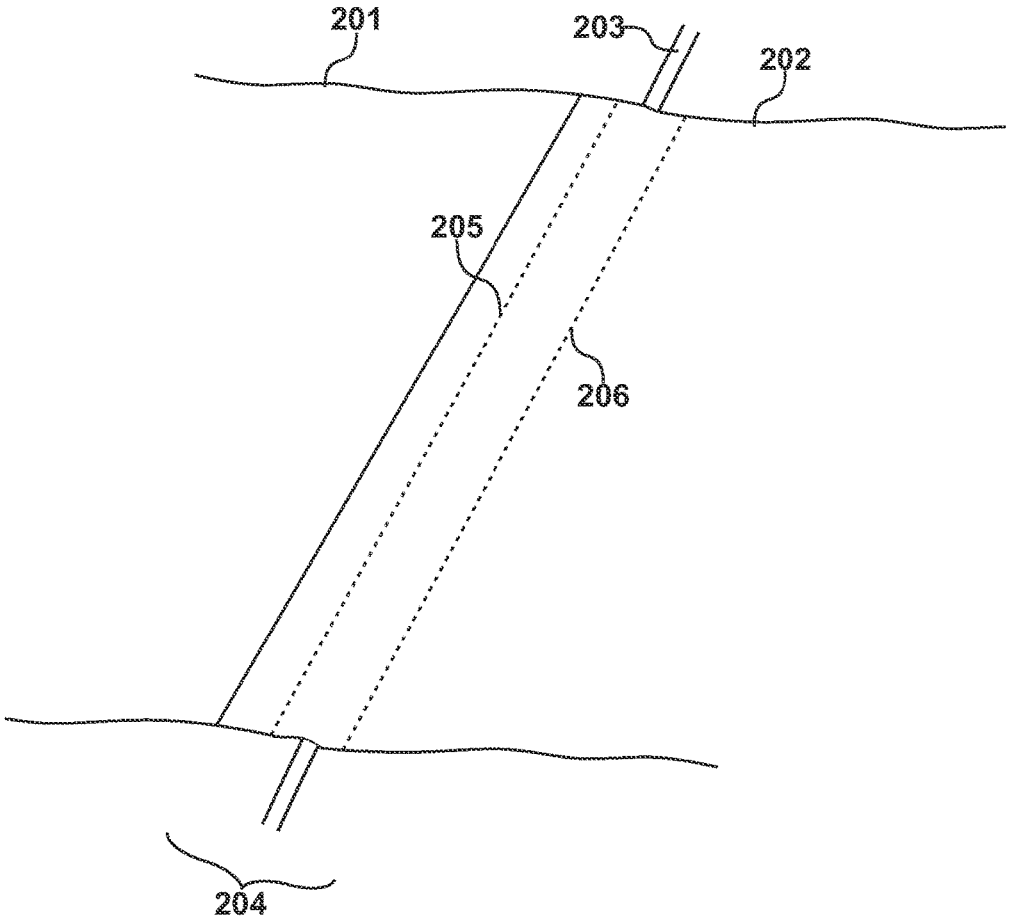
FIG. 2 illustrates the assembly of a clothing item.

A problem with retro-fitting detection and communication devices to existing jackets is that wires connecting components become damaged or detached unless substantial care and time is taken to maintain the jacket. The present applicant has therefore identified the advantageous of securing at least a portion of a wiring loom within one or more seams of the jacket as illustrated in FIG. 2.

In an embodiment, a component 201 is positioned alongside a second material component 202. A portion 203 of a wiring loom is placed over material component 201 and in an embodiment, wire 203 is held in place exclusively by the stitching used to connect the individual material components.

Having located section 203 over material component 201, material component 202 is laid over the combination to provide a region of overlap, indicated by region 204.

A seam is formed, so as to hold material component 201 securely to material component 202 by a first row of stitches 205 and a second row of stitches 206.

FIG. 3

Figure 3:
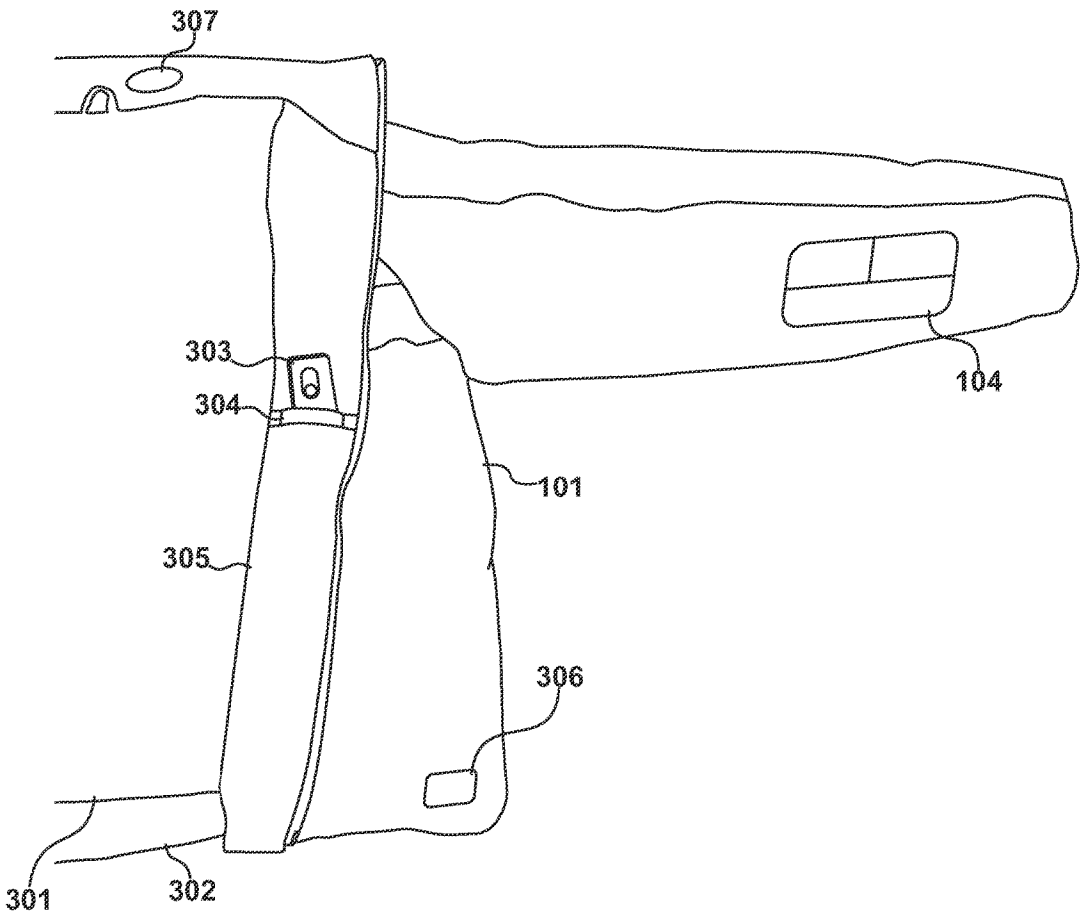
FIG. 3 details a jacket identified in FIG. 1, including an interface device.

Jacket 101 is detailed in FIG. 3. The jacket is constructed from a plurality of layers, of which an internal layer may take the form of a mesh 301 and an external layer 302 may take the form of a high visibility florescent material, for increasing the visibility of the jacket in daylight. Alternatively, outer layer 502 may be of a camouflaged material to achieve the opposite effect.

In an embodiment, a control unit 303 is detachable from a communication wire, such as wire 203, within the jacket so as to allow the control unit to be removed. However, such an operation would be performed when the jacket was being cleaned, possibly in a washing machine, and would not be repeated on a daily basis. From an operational perspective, the control unit 303 is integral to the jacket.

In an embodiment, connectors to the control unit 303 are themselves water resistant, again to facilitate washing. In use, the control unit 303 is restrained within a pocket 304, constructed within an internal surface 305 of the jacket.

Interface device 104 may take many forms. In an embodiment, the interface device includes a plurality of light emitting diodes, possibly of different colours. A first colour could be illuminated to identify a local hazard. Thus, an indicator could be illuminated red to indicate that a hazard has been identified locally. Thus, the jacket includes a hazard detector 306 and a red illumination could be created in response to detector 306 detecting the presence of an undesirable chemical for example.

However, in accordance with an embodiment of the invention, a red illumination is also produced when a detection has been made by a colleague. Thus, a detector on jacket 101 could identify an unwanted local environmental condition, such as the presence of an undesirable chemical, possibly in response to the digging operation being performed, resulting in a red illumination being created at jacket 102 and at jacket 103. This red illumination may be considered as a first type of alarm indication.

In an embodiment, the interface device 104 also includes a blue light emitting diode that is illuminated to indicate that an unwanted environmental condition has been detected by another jacket worn by a colleague. This blue illumination may be considered as a second type of alarm indication.

In an embodiment, the interface device also includes a yellow light emitting diode that is illuminated to indicate that a colleague has been lost, referred to herein as a 'unit-down' condition. Thus, if jacket 102 is identified as belonging to a leader and the user of jacket 103 is taken out of range, this condition will result in a yellow illumination at jacket 102 and a yellow illumination at jacket 101; thereby indicating to these users that a unit-down condition exists and that their activity should be postponed until the group has been reunited. In an embodiment, information of this type may also be conveyed to a base station.

In addition to visual interface device 104, an embodiment is also provided with an audio warning device 307.

FIG. 4

Figure 4:
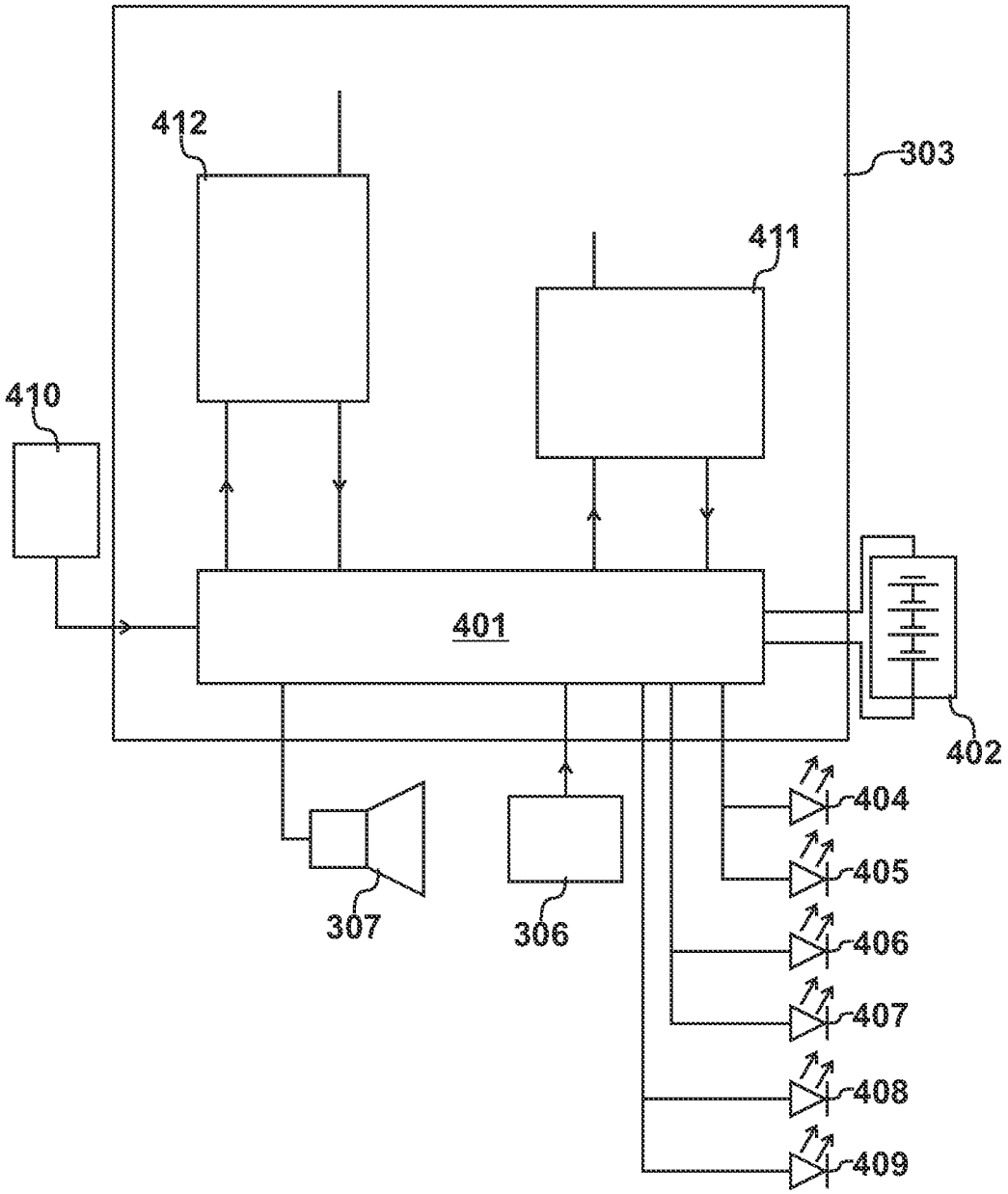
FIG. 4 shows a diagrammatic representation of a control unit identified in FIG. 3.

A diagrammatic representation of control unit 303 is illustrated in FIG. 4. The control unit 303 includes a micro controller 401 that receives power from an external battery 402 also located within the jacket 101. The battery 402 includes voltage regulation circuits that oversee the discharge and recharge of the battery. In an embodiment, the battery 402 is configured to be recharged overnight.

Micro controller 401 is configured to energise visual display devices 403, configured to provide an interface device visible to the user. In an embodiment, these may comprise a red left arm illuminator 404, a red right arm illuminator 405, a blue left arm illuminator 406 a blue right arm illuminator 407, a yellow left arm indicator 408 and a yellow right arm indicator 409. It will be appreciated that many other configurations are possible and alternative output display devices are available.

The micro controller 401 also provides an output signal to the audio alarm device 307.

Input signals to the micro controller 401 are provided by detector 306 and a different detector type 410 is also shown. Detection device 306 may be implemented as a sensor for chemical species or biological species using the technology described in U.S. Pat. No. 7,186,356. Detector 410 may be arranged to detect characteristics of the user, possible measuring heart rate for example. Thus, an alarm condition could be raised if a heart rate is detected as being too high or, alternatively, if a heart rate has been lost. The detector 410 may be implemented as a gas sensor for a particular gas, such as propane, or a family of gaseous compounds, such as light hydrocarbons. The micro controller 401 receives signals from the detector 410 and may generate an alarm when the presence of a substance, including a gaseous substance, is indicated as being present above a threshold level of concentration. As a result, an unwanted local environmental condition is detected. An unwanted local environmental condition may include any condition local to the vicinity of the jacket detectable by the sensor 410. In an embodiment, the sensor 410 is a GPS or GNSS satellite navigation sensor and the unwanted local environmental condition is the location of the jacket. This may include geo-fencing or other location-based thresholding. The location of the jacket may be considered as absolute with reference to geographical coordinates, or the location of the jacket may be considered as a distance to one or a plurality of the other group members.

The micro controller 401 communicates with a local radio device 411 configured to communicate with other articles of clothing forming part of the group. The amount of information exchanged within the group may be relatively low and, when engaged in a multi-user activity, the distance between the members may be relatively short. Thus, in this way, an embodiment makes use of relatively low energy data transmission for data communications between group members.

In an embodiment, each user is also provided with a radio communication device 412 for communicating to a base station, possibly using established protocols and possibly using existing commercial infrastructure. Thus, communication device 412 could be a mobile cellular telephone modem device for example. In an embodiment, external communication device 412 is only active and is only used for a clothing item identified as the group leader. Each jacket may be provided with this functionality and the functionality becomes active when the jacket is designated as leader. In an alternative embodiment, external communication device 412 is only provided to the allocated leader. In addition, a second device may be provided to a leader backup, who is instructed to become leader should the actual leader become detached from the group.

FIG. 5

Figure 5:
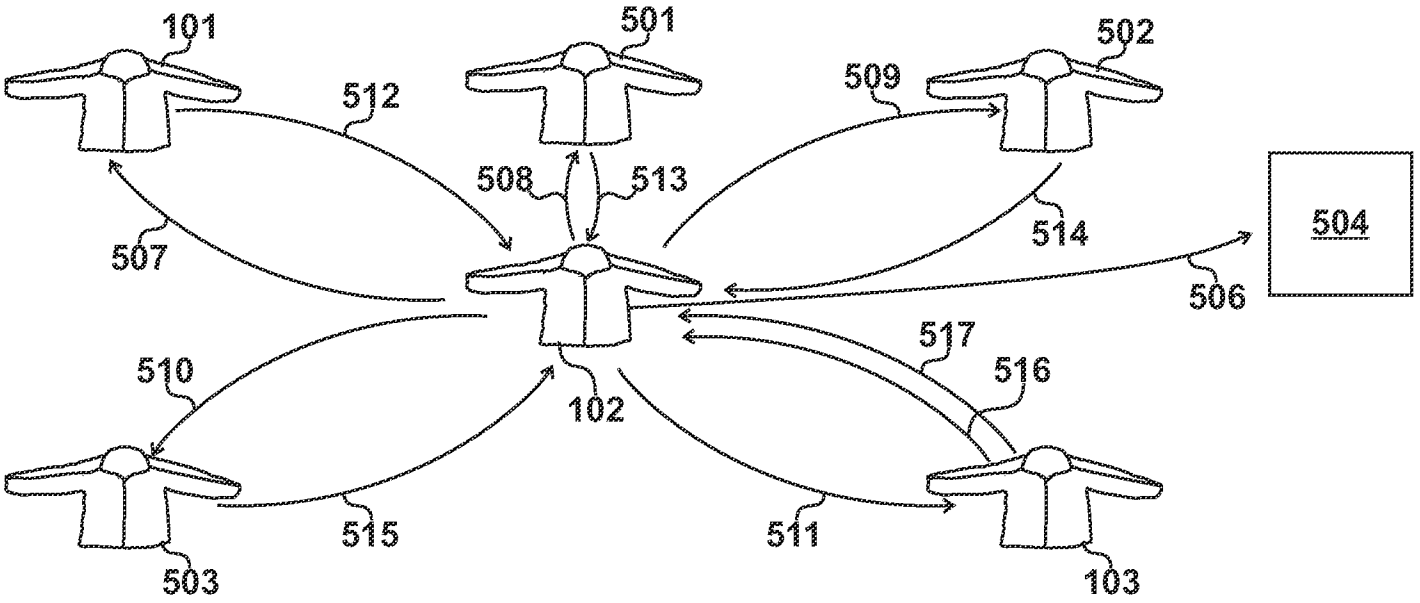
FIG. 5 shows a communication network.

A communication network is shown in FIG. 5, in which a group of clothing items 101, 102, 103, 501, 502 and 503 are associated with a base station 504. The base station is configured to receive information, as illustrated by arrow 506 that has been generated by the individual clothing items and transmitted by the clothing items as output data.

In an embodiment, clothing item 102 has been identified as leader. The leader periodically makes contact with each clothing item, as illustrated at 507 for item 101, at 508 for item 501, at 509 for item 502, at 510 for item 503 and at 511 for item 103.

To show that the clothing item is still within the vicinity and still part of the operational group, they respond back to the leader 102, as illustrated at 512 from item 101, at 513 from item 501, at 514 from item 502, at 515 for item 503 and at 516 for item 103. In addition, item 103, in this example, has relevant information to transmit back, and this transmission back to the leader 103 is illustrated at 517.

FIG. 6

Figure 6:
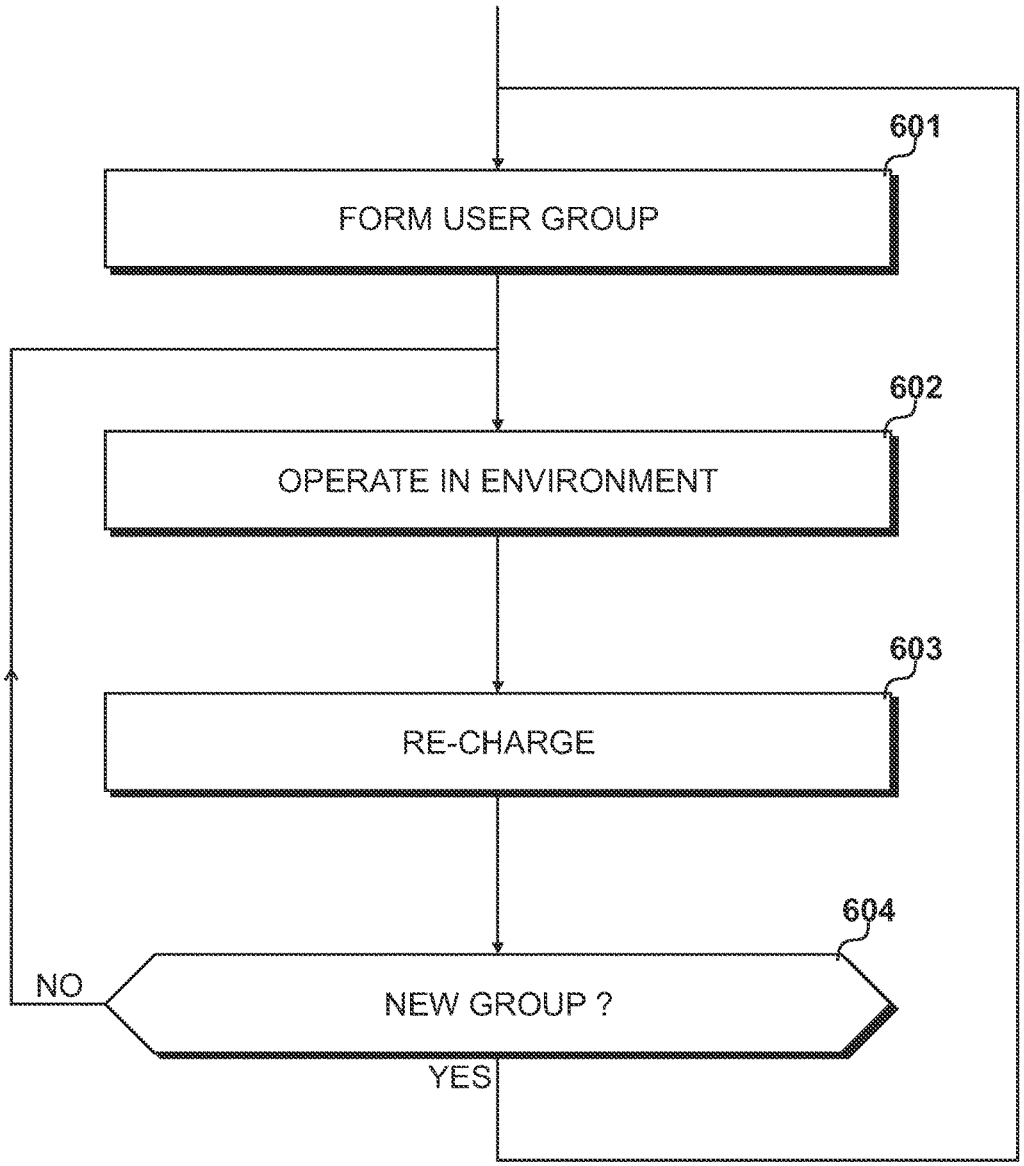
FIG. 6 shows operations performed within a base station identified in FIG. 5.

Operations performed by base station 504 are illustrated in FIG. 6. At step 601, a user group is formed. When produced, the clothing items are substantially similar, except for each being given a unique identification, possibly by the inclusion of an RFID device. A group is then defined by the execution of procedure 601 such that, thereafter, the group may operate in an environment as illustrated at step 602.

After performing a shift within the environment, the operatives remove their jackets such that a recharging operation, as illustrated at step 603 may be performed, possibly overnight.

At the start of the next shift, a question may be asked as to whether a new group is to be defined. Thus, for example, on a first day, twelve operatives may be divided into three groups of four and on the second day they may be divided into four groups of three; subject to the work that is required of them. In the embodiment described herein, a group represents a plurality of operatives that will be working in relatively close proximately and will be to some extent looking out for each other. They may be working in a hazardous environment where hazardous substances may be present. Under these conditions, it is advantageous for a detection made by one operative's jacket to be transmitted to the jackets of the other operatives, such that all of them can make a quick retreat or take appropriate alternative measures.

FIG. 7

Figure 7:
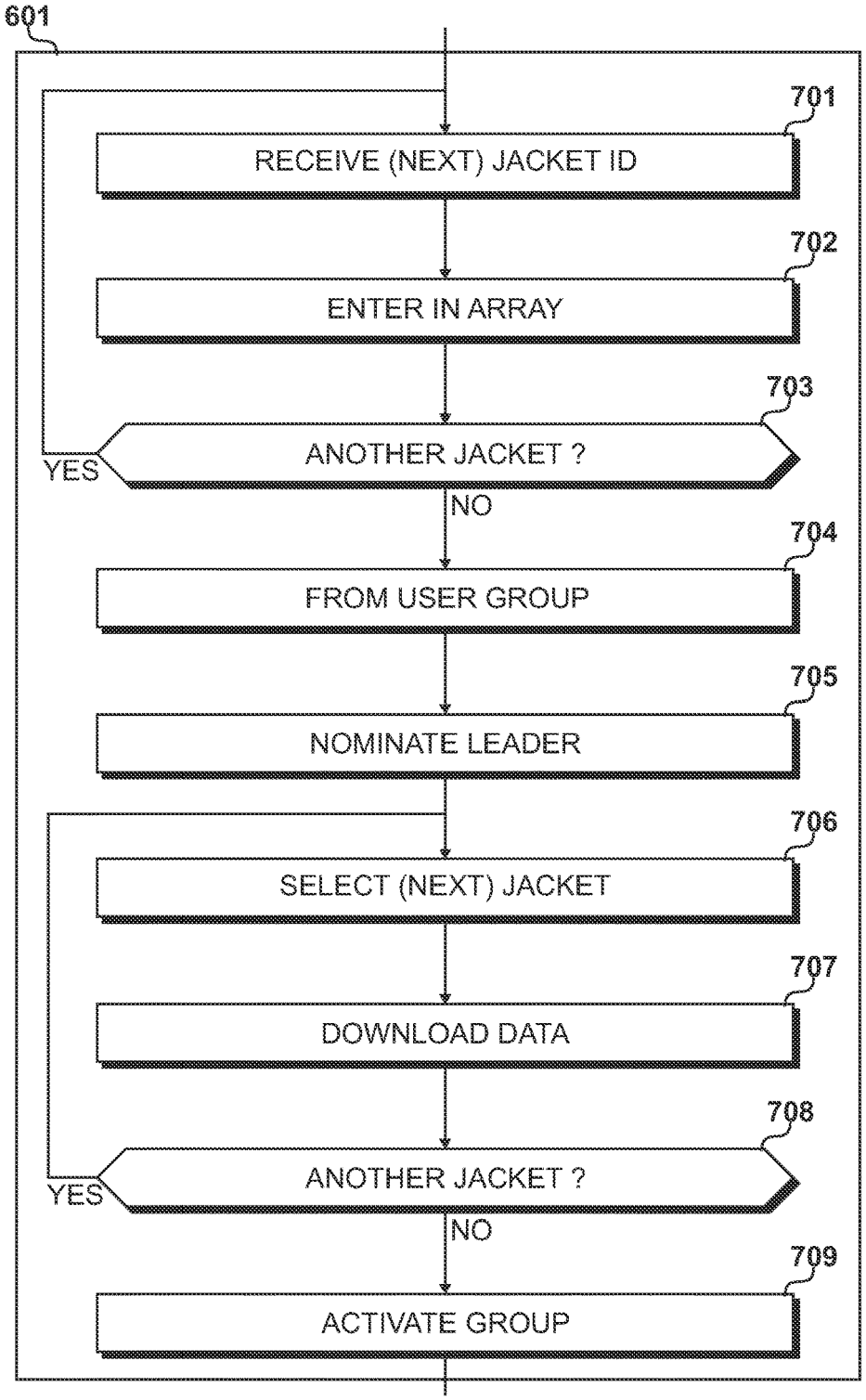
FIG. 7 details procedures for forming a user group identified in FIG. 6.

Procedure 601 for forming a user group is detailed in FIG. 7. To achieve this, an identification of each item of clothing is recorded at a base station. These identifications are transmitted to each other clothing item in the group. In this way, it is possible for each clothing item to transmit locally generated information and for each clothing item to receive information from other items of clothing in the group.

At step 701 the base station receives a jacket identification and at step 702 this identification is entered into an array. At step 703 a question is asked at to whether another jacket is present and when answered in the affirmative, the next jacket ID is received at step 701.

When the question asked at step 703 is answered in the negative, all of the jackets have been considered and a user group is then formed at step 704.

At step 705 a leader is nominated. In a preferred deployment, the leader equipment would be worn by the leader of the group, therefore an appropriate allocation of equipment is required.

At step 706, a jacket is selected and at step 704 a data download is performed, such that the jacket selected at step 706 is provided with information identifying addresses of all of the other jackets in the group at step 707.

At step 708 a question is asked as to whether another jacket is present and when answered in the affirmative, the next jacket is selected at step 706.

When the question asked at step 708 is answered in the negative, all of the jackets will have received data and the group is then activated at step 709.

The activation of the group at step 709 effectively activates the communication network. This position has been achieved by the base station receiving an identification reference for each clothing item in the group. The base station then transmits to each member of the group identification references for all other members in the group.

In this embodiment, one of the clothing items is identified as a leader and a communication channel is established, using device 412, between the base station and the leader. Thus, this may make use of an established communication network, possibly a mobile telephony network or a network deploying established protocols that require minimal energy consumption.

FIG. 8

An example of the array created at step 702 is illustrated in FIG. 8. For each clothing item, an identification reference is identified as shown in column 801. The first device considered has an identification reference IDR1, the second has a reference IDR2, the third has a reference IDR3 the fourth has a reference IDR4 and the fifth has a reference IDR5. Each entry for an identification reference has an address, as shown at 802, identified from A1 to A5. These addresses are relevant within the local communications protocol. Thus, a packet switching protocol may be established within the local environment, with each device responsive to messages received that identifies their relevant address A1 to A5. These addresses may be programmed during the data download operation at step 707. The addresses may be unique within the protocol or they may be addresses allocated from a public network environment. Data encryption, error detection and error correction protocols may also be included.

For the purposes of the local application, each clothing item is given a local group identification; as illustrated by column 803. In an embodiment, identification 001 will default to being leader, although other group members may be allocated dynamically, should a problem arise with respect to the leader's communications.

In the example, column 804 identifies the leader such that group ID 001 receives an affirmative to the effect that they are the leader, with the remaining group members being identified negatively, so as not to be the group leader.

Column 805 provides an address for an external communication channel. Thus, in a mobile telephony network, this external address may represent a cellular telephone number. In the example, group ID 001, as leader, has an external communication address. In this embodiment, should member 001 cease to be leader, member 005 provides a backup leader position and is therefore also provided with an external address EX2.

FIG. 9

Figure 9:
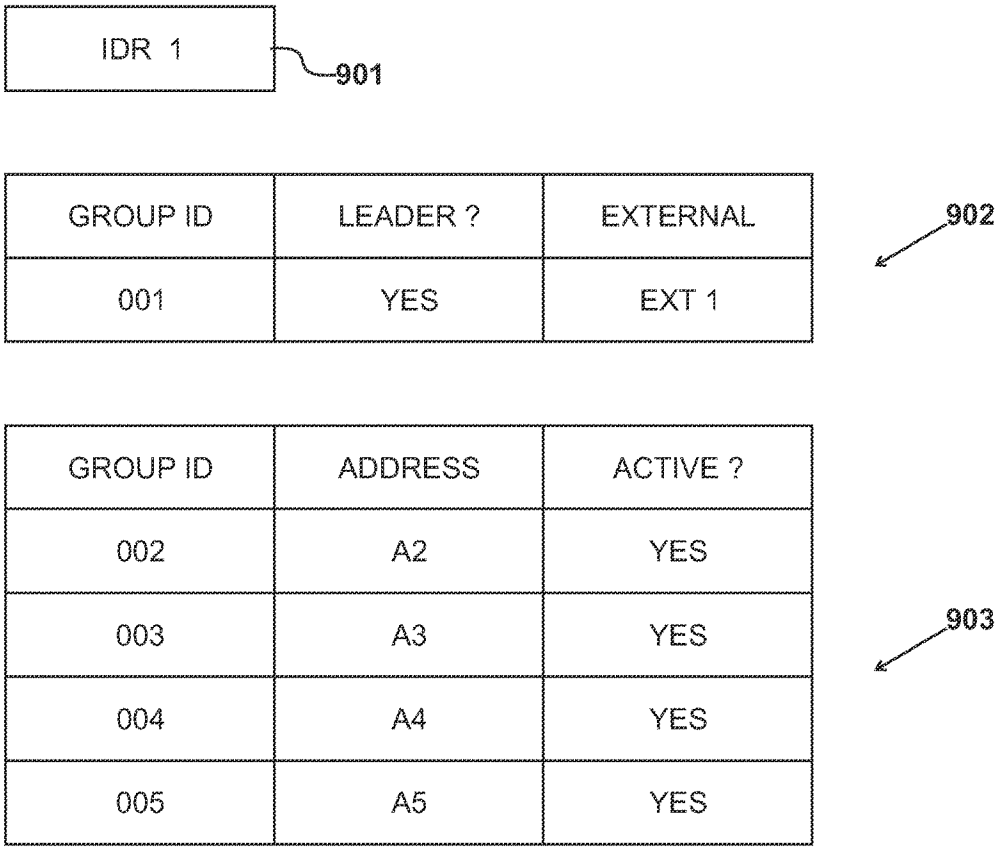
FIG. 9 shows an example of downloaded data in accordance with a procedure identified in FIG. 7.

An example of data downloaded at step 707 is illustrated in FIG. 9. 901 represents the unique identification for the clothing item that has been allocated during manufacture and will be retained until the item is decommissioned.

Portion 902 represents programmed data relevant to that particular item and data group 903 represents the data that has been received relevant to other items within the group. Thus, within data black 902, the local unit has been allocated group ID 001, it has been designated as the leader and has been provided with an external communication address EXT1.

To allow communication within the group, the leader unit has the group ID designations 002 to 005 for the other members within the group. For each of these it has an address A2 to A6 and a flag is also provided to confirm that the device is active.

In an embodiment, users within the group may be instructed to continue with their multi-user activity when all devices are showing an active condition. However, if a condition exists to the effect that one or more of the devices cease to be active, resulting in an appropriate flag setting, alternative measures may be taken, usually to determine the cause of the problem and either rectify the problem locally or withdraw from the situation.

In an embodiment, the leader is configured to maintain communication with other clothing items in the group and generate unit-down information if a communication to a communication item has been lost.

The downloaded data, as illustrated in FIG. 9, allows unit-down information to be generated by performing a polling operation of the items within the group. In this embodiment, the network does not wait for the positive creation of a problematic situation. The approach for detecting a unit-down condition avoids situations in which the absence of data is considered to represent a positive position. A continual polling exercise is performed, such that in each embodiment, each unit must create an acknowledgement signal to the effect that it remains operational. Furthermore, when a unit-down situation is identified, this information is transmitted to all other clothing items within the group.

In an embodiment, after transmitting unit-down information to all members within the group, a period of time, is allocated to allow the members to rectify the position locally. However, if the position has not been rectified locally within a predetermined period of time unit-down information is transmitted to the base station.

In an embodiment, all clothing items within the group also receive information if the leader has lost communication with the base station. Thus, in some situation, this loss of communication with the base station would result in an alarm condition being raised and the operatives possibly returning to base.

FIG. 10

Figure 10:
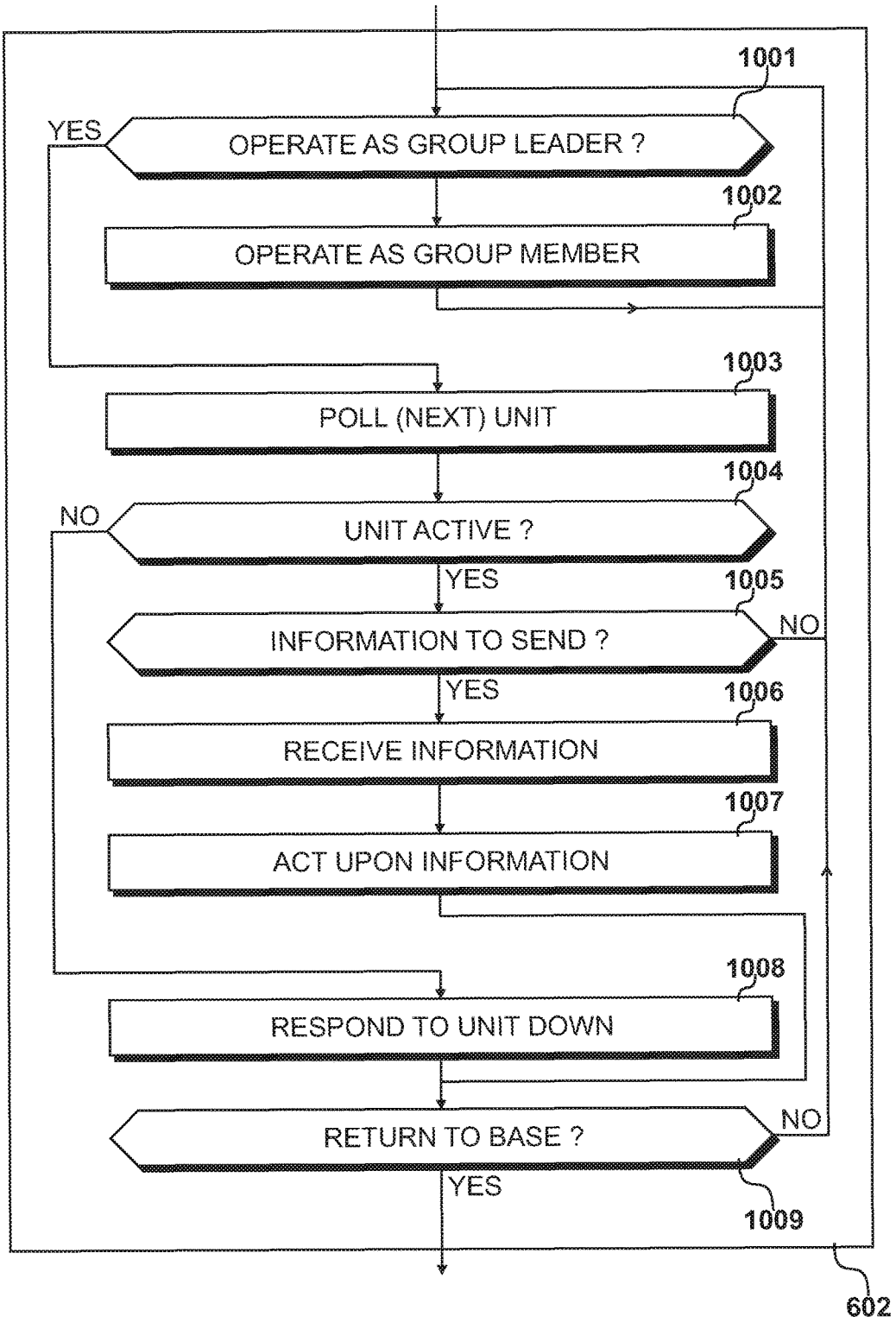
FIG. 10 details procedures performed during an operation within an environment, as identified in FIG. 6, including procedures of operating as a group member, acting upon information and responding to a unit-down condition.

Procedure 602 for operating within the environment is detailed in FIG. 10. At step 1001 a question is asked as to whether the procedures executed by the micro controller 401 should be those of the group leader, identified within the group as 001, or as a group member, identified within the group as 002 or 003. If answered in the negative, control is directed to step 1002, where micro controller operations for a group member's micro controller 401 are executed. Thereafter, control is directed to step 1001. Alternatively, control is directed to step 1003, and the remaining steps of FIG. 10 describe the procedures executed by the micro controller 401 unit of the leader, identified within the group as 001.

At step 1003 the next unit 002 of the group is polled by the group leader 001. Thus, communication 507 is issued by the leader and the leader then waits to receive return communication 511. If a return communication is received, the question asked at step 1004, as to whether the unit is active, is answered in the affirmative.

A further inquiry is made as to whether the unit has information to send. If answered in the affirmative, information is received at step 1006; this information being identified by arrow 516 in FIG. 5. The process then acts upon the information received at step 1007 and the next unit is then polled at step 1003.

If the question asked at step 1005 is answered in the negative, to the effect that a polled unit does not have information to transmit, the next unit is polled at step 1003.

If the question asked at step 1004 is answered in the negative, to the effect that a response has not been received and therefore it cannot be confirmed that the unit is active, a unit-down condition is identified and a response to this is made at step 1008.

A question is asked at step 1009 as to whether it is necessary to return to base, due to an inability to resolve the unit down condition. If answered in the negative, control is returned to step 1001 and the process continues in terms of polling the next unit. However, if the question asked at step 1009 is answered in the affirmative, it is likely that the operatives would be called back to the base station and an end of shift condition could be identified.

FIG. 11

Figure 11:
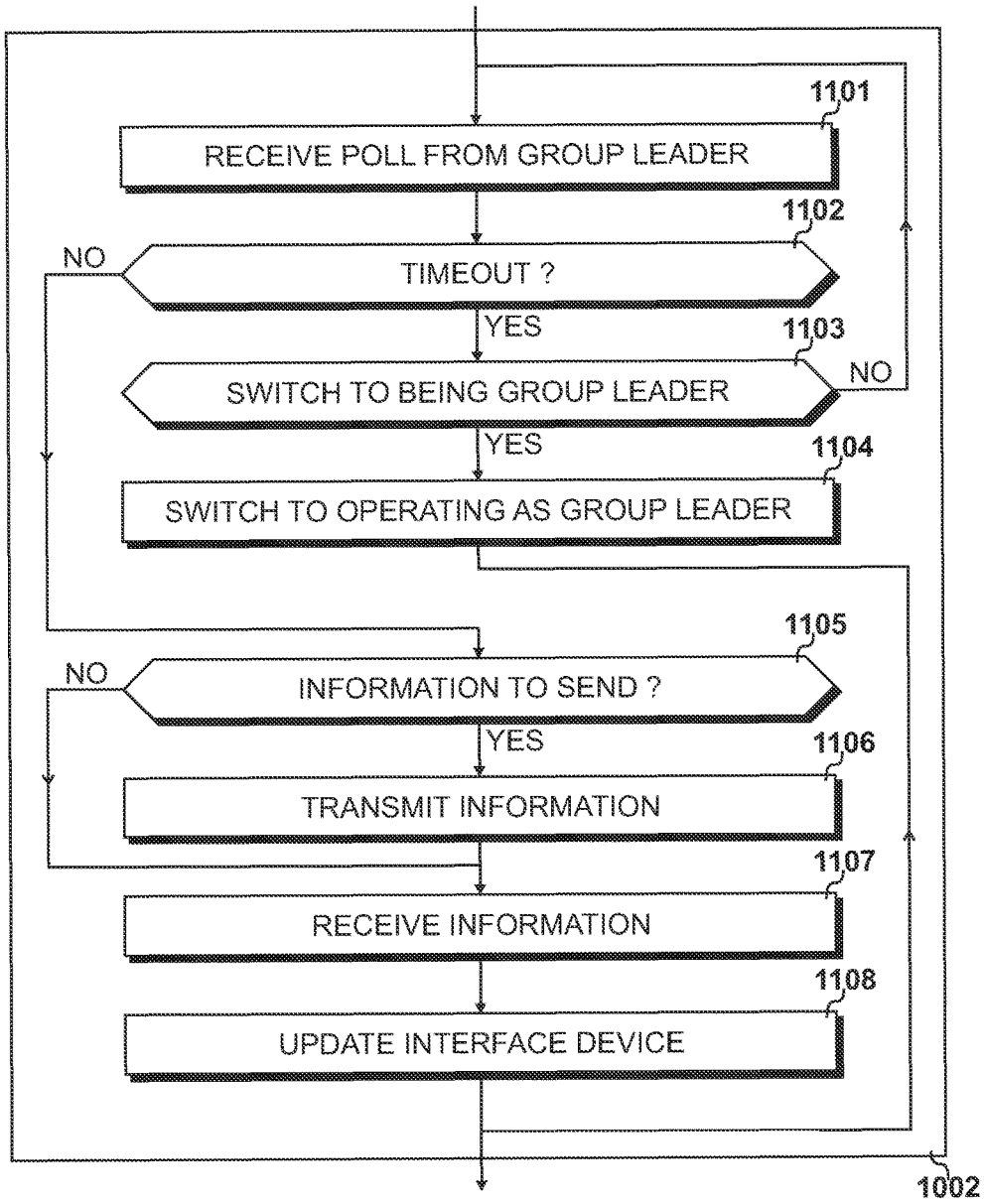
FIG. 11 details the procedure of operating as a group member shown in FIG. 10, including a step of updating an interface device of the kind shown in FIG. 3.

The step 1002 of operating as a group member, shown in FIG. 10, is detailed in FIG. 11. At step 1101 a poll is received from the group leader. If this takes longer than a predetermined length of time, a question asked at step 1102 is answered in the affirmative, indicating that a poll timeout has occurred, and an expected communication from the group leader has not been received as expected. As a result, control is directed to step 1103, where a question is asked as to whether the group member should switch to being the group leader. A protocol to identify whether or not to switching to being group leader is applied. For example, an identical prioritised list of group members may be held in the micro controller memory of each jacket, and the next highest member in this prioritised list is selected. If the selected member is the same as the group member making the decision, then the micro controller 401 of the group member switches to operating as a group leader at step 1104. Alternatively, another member is selected, and control is directed back to step 1101. These steps are repeated until the question asked at step 1102 is answered in the negative and control is then directed to step 1105. Once a new group leader has been selected, control then resumes at step 1001 in FIG. 10.

At step 1105 a question is asked as to whether the micro controller 401 has any new data to send, for example as a result in a change in a local environmental condition such as the level of concentration of a gas or other toxic substance detected by the detector 410. If there is any information to send, control is directed to step 1106, where the information is transmitted to the group leader. At step 1107, information is received from the group leader and at step 1108 the interface device 104 is updated.

FIG. 12

Figure 12:
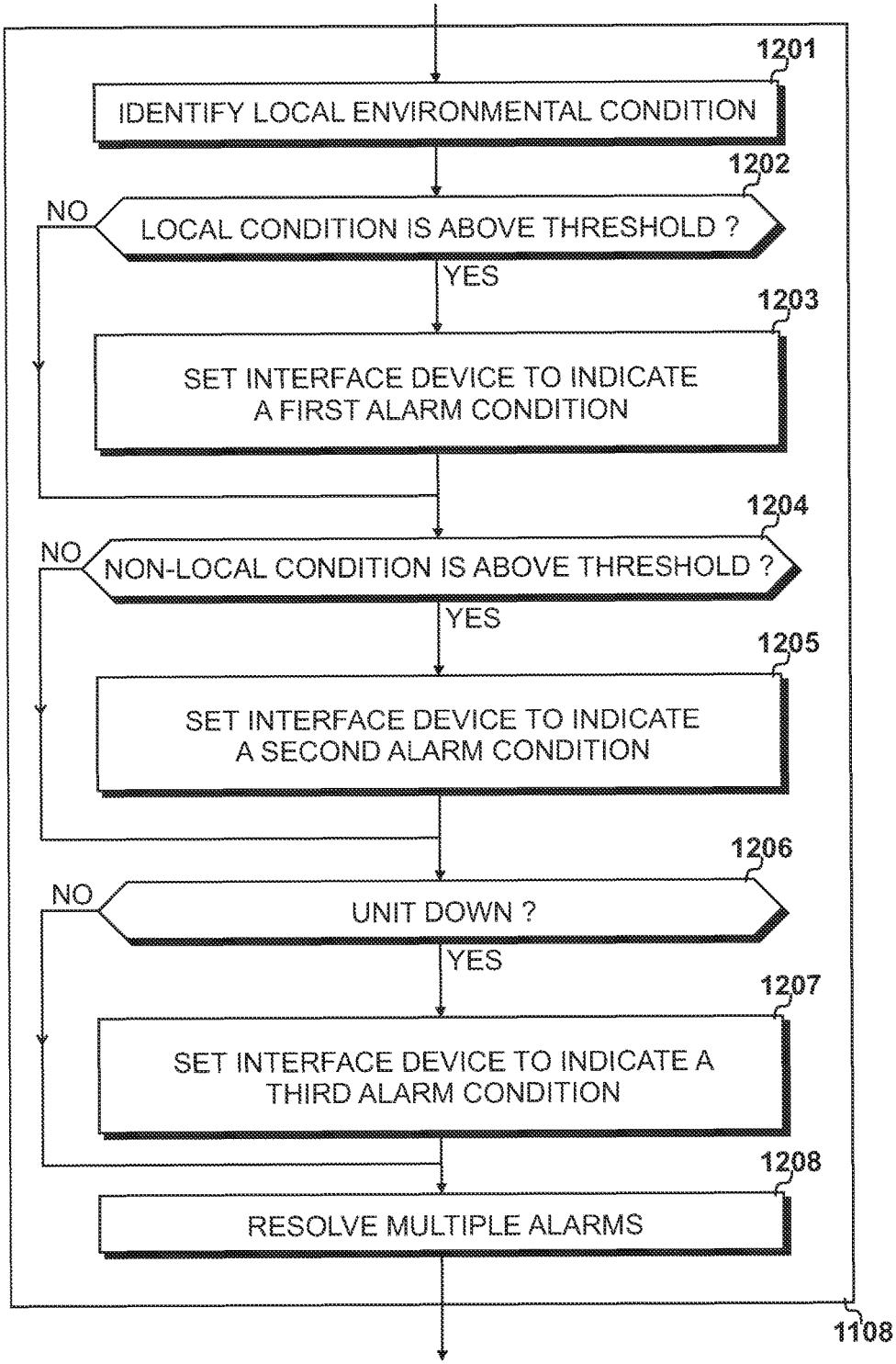
FIG. 12 details the procedure identified in FIG. 11 of updating an interface device.

The step 1108 of updating the interface device, shown in FIG. 11, is detailed in FIG. 12. At step 1201 a local environmental condition is identified. At step 1202 a question is asked as to whether this condition is above a predetermined threshold. In an embodiment, the threshold is a concentration of a toxic gas detected by the detector 410.

If step 1202 is answered in the negative, control is directed to step 1204. Alternatively, if answered in the affirmative, control is directed to step 1203, where the interface device 104 is set to indicate a first alarm condition, such as the illumination of the red light emitting diodes 404 and 405.

At step 1204 a question is asked as to whether a non-local environmental condition is above a threshold. If answered in the negative, control is directed to step 1206. Alternatively, if answered in the affirmative, control is directed to step 1205, where the interface device 104 is set to indicate a second alarm condition, such as the illumination of the blue light emitting diodes 406 and 407.

At step 1206 a question is asked as to whether a unit down condition exists. If answered in the negative, control is directed to step 1208. Alternatively, if answered in the affirmative, control is directed to step 1207, where the interface device 104 is set to indicate a third alarm condition, such as the illumination of the yellow light emitting diodes 408 and 409.

At step 1208 additional processing is performed to identify the coincidence of multiple alarm conditions, and the micro controller selects a pattern of light emitting diode illuminations to clearly indicate the combination of multiple alarm conditions. For example, if a first and a third alarm condition exist simultaneously, the red light emitting diodes 404 and 405 will flash alternately with the yellow light emitting diodes 408 and 409.

FIG. 13

Figure 13:
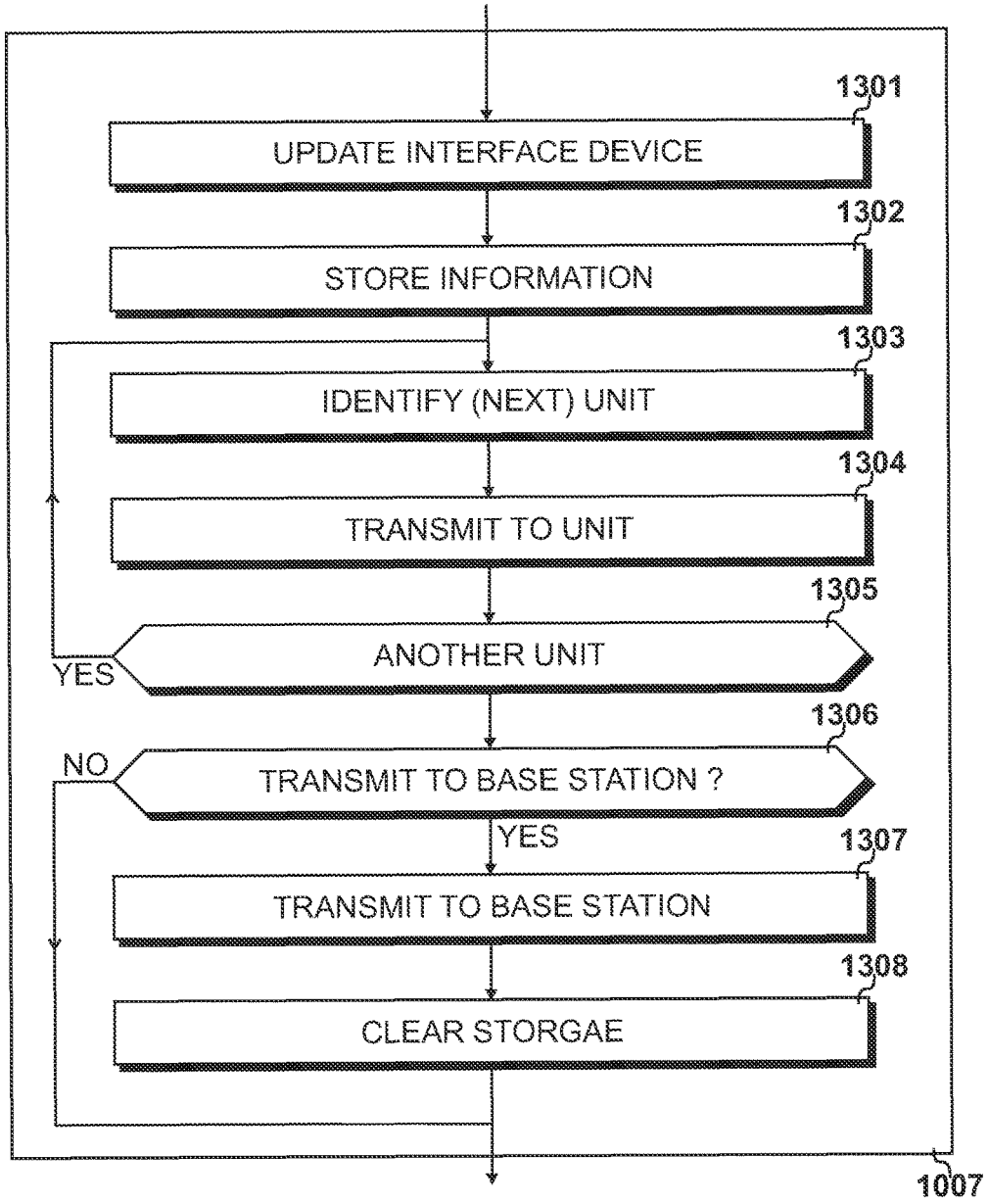
FIG. 13 details the procedure identified in FIG. 10 for acting upon information.

Procedure 1007 for acting upon information received is detailed in FIG. 13. This information is of a type generated by a data generating device at one of the clothing items. Thus, this information may relate to the detection of a hazardous substance or a detection to the effect that an operative is not working within normal medical parameters. A warning may be generated to the effect that the operatives should investigate or evacuate or an alarm condition may indicate a situation to the effect that they should investigate the condition of one of their colleagues.

In some environments, the data generated may indicate the originator of the data. Alternatively, the leader device, when following out the protocol, may indicate the originator of the data. The data may indicate that an operative is experiencing a stressful situation and this may require investigation. The data may also indicate that an operative is working below expectations, possibly incurring less exertion than would normally be expected and statistical models may be developed to determine whether, over time, this does or does not represent an example of satisfactory performance.

At step 1301, the interface device 104 is updated in accordance with the steps of FIG. 12. At step 1302, the information received is stored and in an embodiment, it is possible for multiple examples of information of this type to be stored by repeated execution of step 1302.

At step 1303 the next unit in the group is identified, say, unit 002 and the information is transmitted to the identified unit at step 1304. Thus, if jacket 103 has identified a toxic substance and generated output information, this is transmitted to leader jacket 102. The information is stored and then upon execution of step 1304, the information is conveyed to jacket 101. Thus, in this embodiment, without any communication taking place to a base station, it has been possible for an alarm condition identified at jacket 103 to be conveyed to the user of jacket 101. The operative wearing jacket 101 will have received instruction identifying how to respond to an indication of this type. A toxic substance may be a vapour, a gas or any type of toxic chemical or harmful particle species detectable by the detector 410, including radioactive particles, nanoparticles or any type of particle or chemical that may cause harm to the wearer of a jacket 101 to 103.

At step 1305 a question is asked as to whether another unit is present within the group and when answered in the affirmative the next unit is identified at step 1303 and a transmission then takes place to that identified unit.

In a typical implementation of the procedure shown in FIG. 13, even when using relatively low power and hence relatively slow clock speed devices, transmissions of this type to all users within the group would take place in less than a second. Thus, from the operative's perspective, it would appear as if all were notified simultaneously. However, by communicating individually with each unit within the group, the leader can ascertain with absolute accuracy the location of a particular problem. Furthermore, the robustness of the system can be improved by automatically reallocating the leader functionality should the initial leader encounter problems themselves.

Having transmitted the information to all units within the group, the question asked at step 1305 will be answered in the negative. A question is then asked at step 1306 as to whether the information is to be transmitted to the base station.

In some environments, low level information may be generated all of the time and this may be transmitted to all of the operatives within the group. The information may be very relevant to their local activities and within the local environment it may be appropriate for them to respond rapidly to that incoming information stream.

From the perspective of the base station, the information may only be of a historical interest and the base station would not be required to respond to this information in real time. Consequently, it is possible for the information to be stored and downloaded to the base station periodically. In some situations, the download could take place offline during the recharge process 603. Thus, procedure 1007 may terminate at step 1306.

If the question asked at step 1306 is answered in the affirmative, a transmission to the base station occurs at step 1307. A transmission of this type may take place when the information is identified as being particularly relevant. Thus, if an emergency situation is identified, the question asked at step 1006 would be identified in the affirmative and the transmission to the base station would take place at step 1307.

If the transmission to the base station results in historical data being transmitted, the local storage is cleared at step 1308.

In an embodiment, a particular deployment only relates to information of a single particular type and the issues relating to the storage and forwarding of information to the base station will be preconfigured in a way that is appropriate to the type of information that is being collected. In an alternative embodiment, different types of information are detected and the system will respond appropriately having identified the type of information that has been received.

FIG. 14

Figure 14:
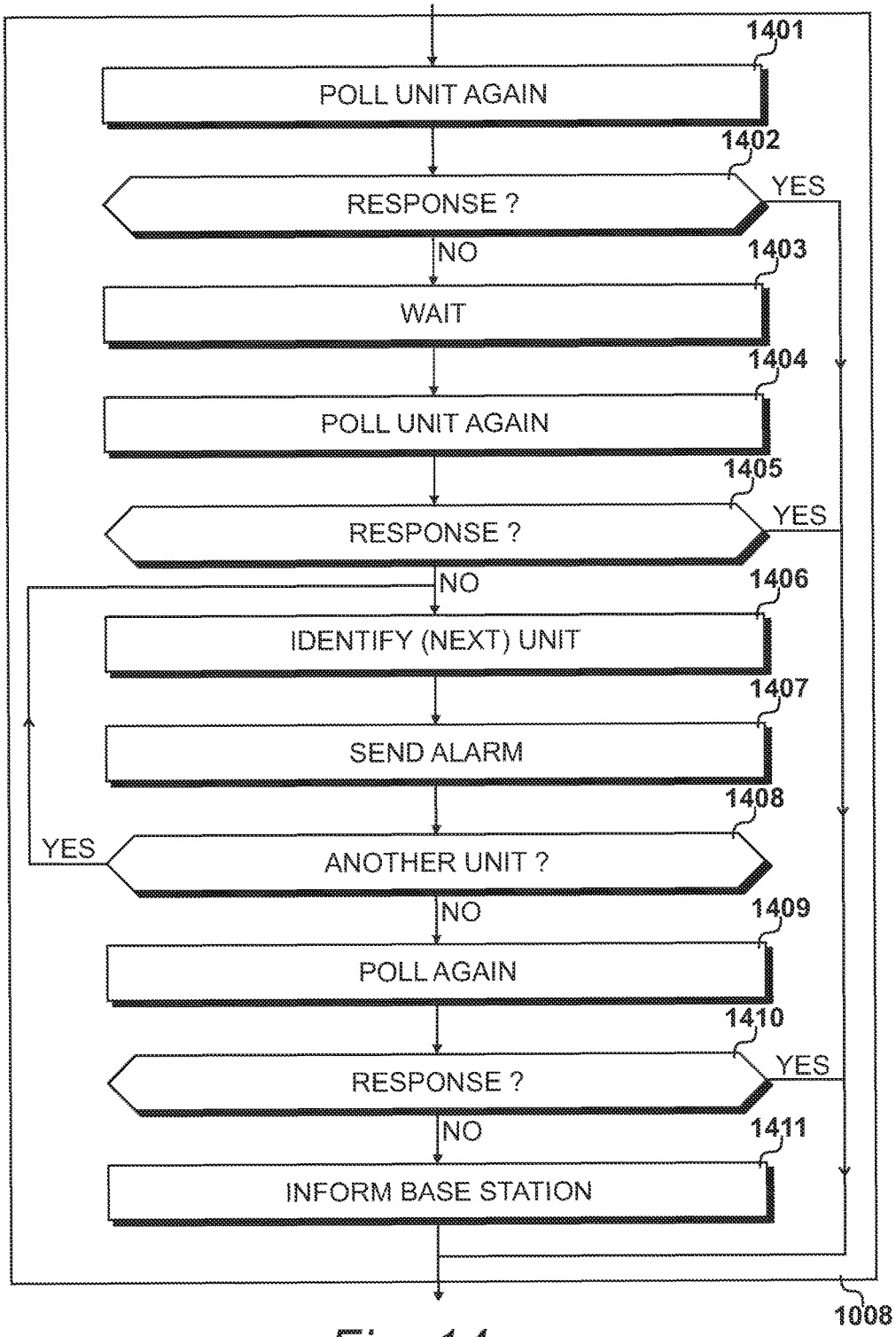
FIG. 14 details procedures identified in FIG. 10 for responding to a unit-down condition.

Procedures 1008 for responding to a unit-down condition are identified in FIG. 14.

As described with respect to FIG. 10, a unit-down condition is detected because a unit fails to respond to a polling inquiry made to request information. Thus, to para-phrase the transaction, the leader asks whether the other group member is active and said other group member is required to confirm that it is active. The leader then asks for information and remains receptive to this information. However, if the group member does not confirm that they are active, it is assumed that a problem exists.

Operatives would be under instruction to act in an appropriate way in response to a condition of this type being detected. Thus, in some environments, operatives may stop performing their multi-user activity and direct all their attention to determining the issue with respect to the unit-down situation.

At step 1401, the unit is polled again and is therefore given another opportunity to provide a confirmation to the effect that the unit is active. Thus, it is appreciated that an operative may have gone temporarily out of range or may have gone behind something that obscures a transmission signal. Furthermore, in an embodiment, it is possible that the signal strength could be increased during the poll again operation at step 1401.

If the question asked at step 1402 is answered in the negative, a wait state is entered at step 1403 and the poll again operation is performed again at step 1404. Again, signal strength may be increased; an assumption is made that this is only a temporary problem.

At step 1405 a question is again asked as to whether a response has been received and if answered in the negative it is assumed that the problem has escalated. Consequently, an alarm condition is conveyed to all of the other members of the group.

At step 1406 a member of the group is identified and an alarm signal is sent at step 1407. At step 1408 a question is asked as to whether another unit is present in the group and, if answered in the affirmative, the next unit is identified at step 1406. Thus, the alarm condition is transmitted to all of the members in the group.

After notifying all of the other members in the group of the alarm condition, the question asked at step 1408 is answered in the negative and the lost unit is polled again at step 1409. Thus, an assumption is made that other operatives will have identified the problem and brought the missing member back within communication range. Thus, there is an expectation that a response will be received. Thus, a question is asked at step 1410 as to whether a response has been received.

If the question asked at step 1410 is answered in the negative, to the effect that a response as not been received, the base station is informed of this situation at step 1411. Thus, in response to receiving a signal of this type, the base station may deploy other operatives to investigate the situation and normal operations will cease. Thus, in response to such a condition, the question asked at step 1009 will be answered in the affirmative. If during the procedures illustrated in FIG. 14, a response is identified, by questions asked at step 1402, 1405 or 1410 being answered in the affirmative, it is likely that the question asked at step 1009 will be answered in the negative, such that operation in the environment may continue.

The invention claimed is:

1. An apparatus for use in a multi-operative activity, during which there is a risk of one or more of said operatives being exposed to an environmental hazard, the apparatus comprising:

a plurality of items of clothing, wherein each said item of clothing is worn by a respective operative and a plurality of detectors for detecting an environmental hazard;

each detector configured to be detachably attached to one of said items of clothing, wherein each item of clothing comprises:

a control unit;

permanently attached light emitting devices configured to emit light in a plurality of colors:

a transmitter connected to the control unit;

a receiver connected to the control unit;

a loom of conductors within said item of clothing connecting the control unit to the light emitting devices and to the detachably attached detector; wherein the control unit is configured to:

receive a first warning signal from the detachably attached detector and relay said first warning signal in response to detecting said environmental hazard;

illuminate one or more of the light emitting devices in a first predetermined color in response to receiving the first warning signal;

receive a remote second warning signal from a remote source; and illuminate one or more of the light emitting devices in a second predetermined color different from the first predetermined color in response to receiving the second warning signal.

2. The apparatus of claim 1, wherein each said item of clothing includes a processing device and a battery for supplying electrical energy to said processing device, said detector, said first warning device and said second warning device via the loom of conductors.

3. The apparatus of claim 2, wherein a substantial proportion of said loom of conductors is restrained within seams forming part of the item of clothing.

4. The apparatus of claim 1, wherein each item of clothing is a jacket.

5. The apparatus of claim 1, wherein said environmental hazard non-exclusively includes: chemical hazards, including poisonous gases and vapours; biological hazards; and physical hazards including radiant heat, convected heat, ionizing and non-ionizing radiation.

6. The apparatus of claim 1, including a third warning device configured to emit an audible warning in response to a condition selected from options of: the generation of said first warning; the generation of said second warning; and the generation of either said first warning or said second warning.

7. A method of warning operatives when working on a multi-operative activity of the presence of an environmental hazard, comprising the steps of:

providing each operative with an item of clothing having a detachable detector for detecting an environmental hazard;

providing a control unit within said item of clothing;

providing a loom of conductors restrained within said item of clothing;

providing light emitting devices permanently attached to said item of clothing and connecting the light emitting devices with the control unit via said loom of conductors;

providing a transmitter and a receiver attached to the control unit;

providing a base station adapted for receiving first warning signals and transmitting second warning signals;

wherein the control unit is configured to perform the steps of:

receiving the first warning signal from the detachable detector;

issuing a first warning in response to detecting said environmental hazard;

illuminating at least one of said light emitting devices in a first predetermined color responsive to said first warning;

transmitting the first warning signal;

receiving a remote second warning signal from a remote source;

issuing a second warning in response to the reception of the second warning signal; and illuminating at least one other of said light emitting devices in a second predetermined color different from the first predetermined color responsive to said second warning.

8. The method of claim 7, including the step of activating an audible alarm in response to the issuing of said first warning.

* * * * *